US006510901B2

(12) United States Patent
Yen et al.

(10) Patent No.: US 6,510,901 B2
(45) Date of Patent: Jan. 28, 2003

(54) PORTABLE FIRE PROTECTION APPARATUS AND METHOD USING WATER MIST

(75) Inventors: Ping-Li Yen, 185 W. Norman Ave., Arcada, CA (US) 91007; Zhigang Liu, Ottawa (CA); Donald W. Carpenter, Ottawa (CA); Andrew K. Kim, Gloucester (CA)

(73) Assignee: Ping-Li Yen, Arcadia, CA (US)

( * ) Notice: Subject to any disclaimer, the term of this patent is extended or adjusted under 35 U.S.C. 154(b) by 0 days.

(21) Appl. No.: 09/832,452

(22) Filed: Apr. 12, 2001

(65) Prior Publication Data

US 2002/0148621 A1 Oct. 17, 2002

(51) Int. Cl.[7] ..... A62C 2/00

(52) U.S. Cl. ..... 169/47; 169/46; 169/65; 169/71; 169/74

(58) Field of Search ..... 169/46, 47, 65, 169/30, 71, 74

(56) References Cited

U.S. PATENT DOCUMENTS

| | | | |
|---|---|---|---|
| 3,463,233 | A | 8/1969 | Haessler |
| 3,584,688 | A | 6/1971 | Duncan |
| 3,653,443 | A | 4/1972 | Dockery |
| 3,691,936 | A | 9/1972 | Chiarelli |
| 3,866,687 | A | 2/1975 | Banner |
| 3,889,754 | A | 6/1975 | Dunn |
| 4,356,870 | A | 11/1982 | Gaylord et al. |
| 4,524,835 | A | 6/1985 | Mingrone |
| 4,813,487 | A | 3/1989 | Mikulec et al. |
| 4,834,188 | A | 5/1989 | Silverman |
| 5,127,479 | A | 7/1992 | Stehling et al. |
| 5,129,386 | A | 7/1992 | Meister |
| 5,165,483 | A | 11/1992 | Fox |
| 5,297,636 | A | 3/1994 | North |
| 5,697,450 | A | 12/1997 | Stehling et al. |
| 5,871,057 | A | 2/1999 | Stehling et al. |
| 6,173,791 | B1 | 1/2001 | Yen |

*Primary Examiner*—Robin O. Evans
(74) *Attorney, Agent, or Firm*—William W. Haefliger

(57) ABSTRACT

The method of extinguishing a fire characterized by production of flames openly rising above an upwardly presented liquid fat or grease zone, in a fryer, the fat or grease being combustible to produce the fire, the steps that include locating a mist forming nozzle to direct mist toward the flames, delivering essentially pure water under pressure to the nozzle so that the nozzle forms a jet stream of water mist delivered from the nozzle as a rapid and expanding flow of concentrated mist and directing said mist stream into the flames to substantially encompass the flames, and to flow toward the fat or grease zone, and for a sufficient time to extinguish the flames and to lower the temperature of the surface of the fat or grease zone to a level below combustion temperature.

2 Claims, 3 Drawing Sheets

PORTABLE FIRE PROTECTION APPARATUS AND METHOD USING WATER MIST

BACKGROUND OF THE INVENTION

This invention relates generally to suppression of accidental fires, for example those involving cooking oil or fat, and more particularly concerns employment of portable equipment and method for producing pure water mist useful in such suppression, as well as extinction of such fires.

In recent years, the development of high-efficiency cooking equipment with high energy input rates and the widespread use of vegetable oils with high burning temperature have increased potential risks to life and property loss. Almost 50% of all accidental fires in hotels, restaurants and fast food outlets start in kitchens and the majority of these involve liquid cooking oil or fat fires. These fires are the hardest to extinguish and are easily re-ignited. Suppressing cooking oil fires has been identified as the primary fire challenge in restaurant cooking areas. Recently cooking oil fires, due to their different behavior from other types of liquid fuel fires, were re-classified into a new class of fire, Class K, by the National Fire Protection Association (NFPA); a similar classification is also being considered by the Loss Prevention Council and other agencies around the world.

Previous studies showed that foam, powder and carbon dioxide are not as effective in suppressing cooking oil fires as they are for other types of liquid fuel fires. Currently, wet chemical agents, as defined by NFPA-17A, are the primary means used to extinguish grease fires in cooking areas. They are effective in extinguishing these fires, but may cause irritation to the skin and eyes as well as clean-up problems after fire extinguishment. Furthermore, the system cost of wet chemical agents is relatively high. As a result, there is a significant need or improving fire safety and for reducing the cost of protecting restaurant cooking areas through the introduction of a portable extinguishing system or systems.

SUMMARY OF THE INVENTION

It is a major object of the invention to provide method and apparatus to efficiently and effectively suppress such fires, through use of portable apparatus to produce water mist. Such mists are non-toxic, and do not contribute to environmental problems.

Basically, the invention provides a method of extinguishing a fire characterized by production of flames openly rising above an upwardly presented liquid fat or grease zone, the fat or grease being combustible to produce the fire. The steps of the method include a) providing a container containing pressurized aqueous liquid, b) providing a valve controlled outlet from said container, there being a valve controlling handle, c) providing an elongated flexible tube having an inlet end to receive said pressurized liquid, and having an outlet end, d) providing an elongated relatively stiff metallic tube having an inlet end in communication with the flexible tube outlet end, said metallic tube having an angled outlet end portion that extends at an angle a relative to a length direction,of the metallic tube, where $$\alpha > 50°,$$

e) providing a mist producing nozzle at said outlet end portion, f) and releasing pressurized liquid from the bottle and tubes, by operation of said handle, and via said nozzle to produce said mist while manipulating said elongated tube to cause mist discharge downwardly toward said flaming liquid fuel bath.

An added object is to provide portable apparatus for quicker movement to a fire location, and that includes:

a) a portable container and a pressurized aqueous liquid therein, b) an elongated flexible tube having an inlet end to receive pressurized liquid from the container, and having an outlet end, c) an elongated relatively stiff metallic duct having an inlet in communication with the flexible tube outlet end, said duct having an angled outlet end portion that extends at an angle $\alpha$ relative to a length direction of said duct, where $$\alpha > 50°,$$

d) and a mist producing nozzle located at the outlet end of the duct, whereby liquid flows via a pressure releasing valve from the container, the duct and nozzle, as mist, while the duct is manipulated to cause said duct end portion to extend at said angle $\alpha$, for encompassing the flames with mist.

Another object includes the step of providing the metallic tube to be of a length to enable grasping of the tube at a location closer to the flexible tube then to said angled end portion of the metallic tube. As will be seen, manipulation of the tube is effected to cause its angled outlet end portion to extend downwardly at an angle less than 35° relative to vertical, to ensure that the downward stream of mist expands in flowing downwardly, to quickly encompass, cool and extinguish the flames. Water is delivered from the container at a pressure such that mist droplets form, and have cross sections less than 1000 microns.

It is another object of the invention to carry out the method to effect rapid conversion of such mist to steam, which expands outwardly about the fat or grease zone, and rapidly blankets or hovers closely about that zone, blocking air or oxygen access to the fat or grease zone.

Rapid mist stream formation and travel into the flames is effected by supply of pure water to the nozzle at a pressure level between 150 and 250 psi, and preferably above 175 psi. Also, the length of time needed for mist stream delivery toward the fat or grease zone is typically less than about 15 seconds, for effecting flame extinction. The use of mist instead of water droplets assures such rapid flame extinction, since mist provides maximum water surface area exposed to the flame, with wide area distribution.

A yet further object is to provide portable fire fighting apparatus that meets multiple "K" rating requirements, as follows:

A) protects against flames resulting from combustion of paper, wood, cloth and plastic materials B) protects against flames produced by combustible liquids, such as fats.

C) Is electrically non-conductive

D) Is useful to put out fires produced in commercial kitchens.

These and other objects and advantages of the invention, as well as the details of an illustrative embodiment, will be more fully understood from the following specification and drawings, in which:

DRAWING DESCRIPTION

DETAILED DESCRIPTION

Figure 1:
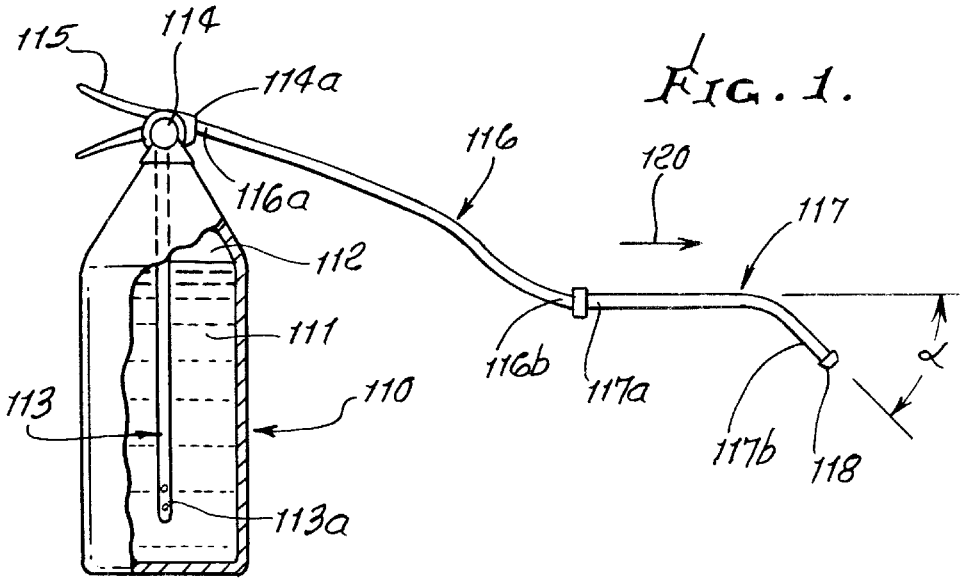
FIG. 1 is a view showing a system employing the invention.
Figure 2:
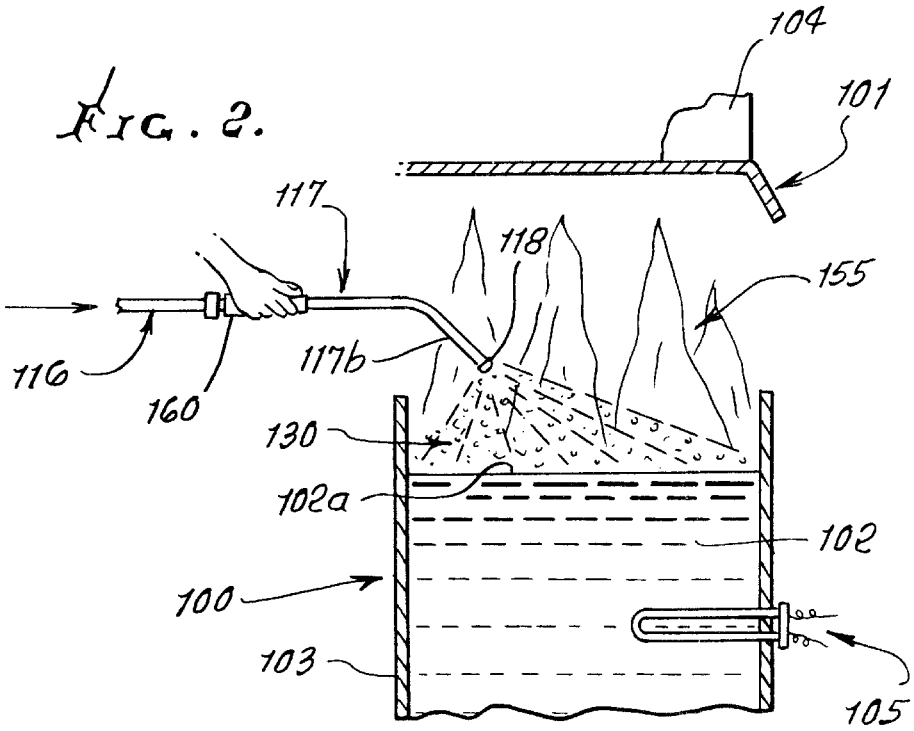
FIG. 2 is an enlarged vertical section taken through a fryer unit, a hood, and showing positioning of a nozzle below the hood and above a liquid fat zone in the fryer unit.
Figure 3:
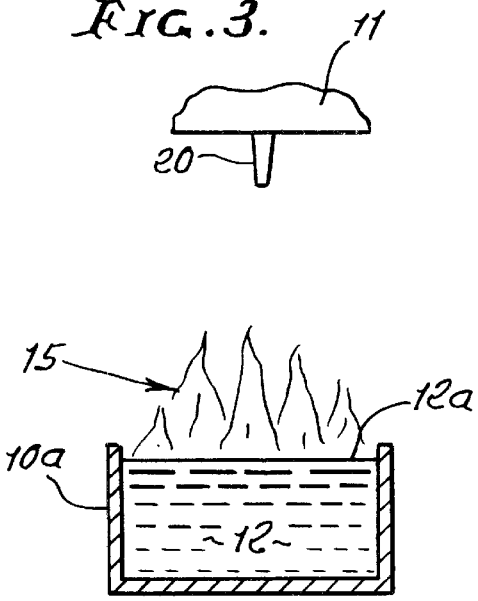
FIGS. 3–6 are diagrammatic elevational views, showing stages in flame and fire suppression, using directed mist.

In FIGS. 1 and 2, a fryer unit 100 is positioned below a hood 101. Fumes rising from cooking oil or fat 102 in the receptacle or vessel 103 of unit 102 collect in the hood and are exhausted via a duct 104. The fat 102 is typically heated to elevated temperature, as for example by electrical or gas heating means, indicated generally at 104, and it is highly desirable to provide portable equipment operable to quickly and effectively suppress a fire or flames that may occur, as indicated at 105 in FIG. 2. Such flames otherwise tend to rapidly grow due to rising temperature at the surface zone of the fat in the fryer, and if the flames continue to rise toward and closer to the hood, there is extreme danger of outbreak of fire in the hood, risking outbreak of fire in a building structure containing the fryer and hood.

FIG. 1 shows a container 110 such as a bottle to contain pressurized aqueous liquid 111 for flame suppression. Such liquid is pressurized as by use of non-combustible pressurized gas 112 (for example nitrogen) in the container, acting to urge the liquid toward a lower inlet 113*a* of a tube 113 in the container. The tube conducts pressurized liquid 111 toward a valve controlled outlet from the container. That outlet may be the outlet 114*a* from a valve 114 at the top of the container, and which is manually controlled by movement of a lever 115, as is known. The pressure of gas 112 is typically about 195 psi.

An elongated flexible tube 116 has an inlet 116*a* communication with valve outlet 114*a,* the tube having an outlet end 116*b*. The tube length is typically between 2 and 4 feet, allowing extreme manipulative sideward displacement of the tube 111, as well as of a metallic tube 117, and of a nozzle 118. The tube 116 may consist of reinforced elastomeric material.

The elongated, stiff metallic tube 117 has an inlet 117*a* in communication with the flexible tube outlet 116*b*. The tube 117 has an angled outlet end portion 117*b* that extends at an angle a relative to the length direction 20 of the tube 17 main extent, and where a exceeds 50° and is typically about 60°.

The mist producing nozzle 118 is located at the outlet end of the tube 117 angled outlet end portion 117*b,* such mist forming droplets with cross sections between 400 and 1000 microns, for best flame suppression action and results.

As is seen in FIG. 2, the tube 117 is grasped, as at a handle 160 on 117, close to tube 116, and displaced (as allowed by flexible tube 116), i.e. manipulated, to cause mist discharge downwardly at 130 toward the flames 155, as for example may be produced by a flaming liquid fuel (i.e. fat) bath 102. Thus, if tube 117 extends approximately horizontally, end portion 117*a* extends at about 60° from horizontal, as shown, whereby the downwardly flowing mist 130 diverges to encompass the flame zone.

In a test, the cooking oil in a fryer was allowed to self-ignite, and flame for one minute. The preferred portable flame suppression equipment as described was then operated, and resulted in rapid flame suppression and extinction.

The container or pressure vessel 110 is typically provided to contain between 6 and 9 liters of aqueous liquid, such as pure water. The container itself is preferably formed of non-corrosive metal, such as stainless steel.

As referred to, forceful mist stream is directed into the flames to substantially encompass the flames, and to flow toward the fat or grease zone, and for a sufficient time to extinguish the flames and to lower the temperature of the surface of the fat or grease zone to a level below combustion temperature. Water mist droplets have very great total surface area, acting to rapidly lower temperature in the flame area and fat zone. Usable mist particles are less than 1000 microns in cross section. Water under gaseous (for example $N_2$) pressure preferably between about 170 and 250 psi is sufficient to form such mist particles at the nozzle, and to drive them onto the fire, as at a fryer, to very rapidly extinguish the fire, and without excessive pressure as would slow down the extinction.

Figure 4:
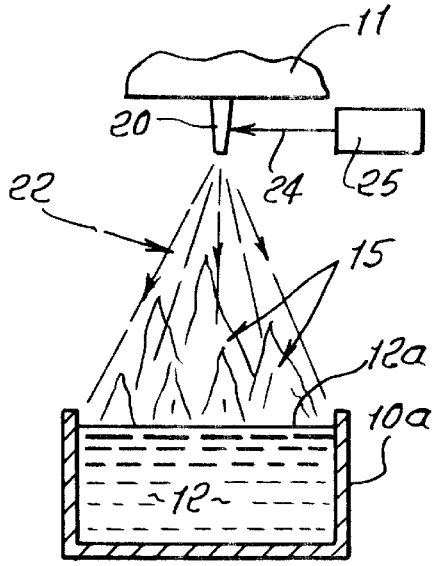
Figure 5:
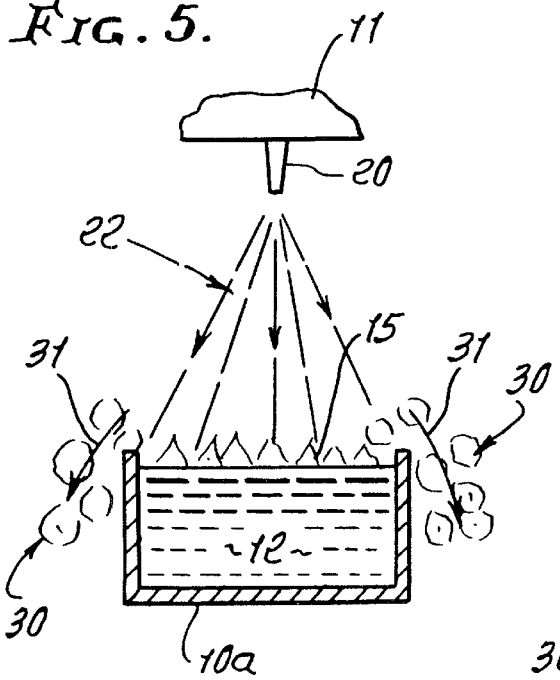
Figure 6:
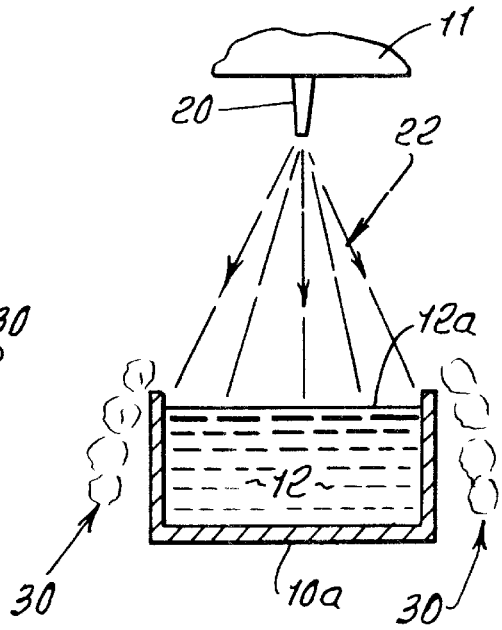

Note further in FIGS. 3–6 that the downward mist stream cone 22 diverges to substantially encompass the area of the fat surface zone 12*a* in the fryer. FIG. 4 shows initial suppression and lowering of the flames 15; FIG. 5 shows substantially complete suppression of the rising flames by continued mist delivery; and in FIG. 6, the flames have been extinguished and the surface zone of the fat in the fryer is being cooled by the mist from cone 22. FIGS. 5 and 6 also show conversion of some of the mist to steam, by contact with flames and hot fat, the steam billowing at 13 laterally from the zone 12*a,* and downwardly at 31 adjacent the fryer unit, blocking or interrupting flow of air and oxygen to the zone 12*a* and to the flames, assisting in flame suppression.

The time for mist flow in sufficient quantity to extinguish the flames, as described is less than 10 seconds, and mist flow may be continued to cool the surface of the fat in the fryer to a level below about 180° C., to assure against spontaneous re-combustion.

The portable system as described satisfies the following requirements:

A—extinguishes fire produced by combustion of paper, wood, cloth, or plastic material, B—extinguishes fire produced by combustion of flammable liquid, C—is electrically non-conductive (for example tube 116 is non-conductive), K—extinguishes fires produced in or at commercial kitchens.

Figure 7:
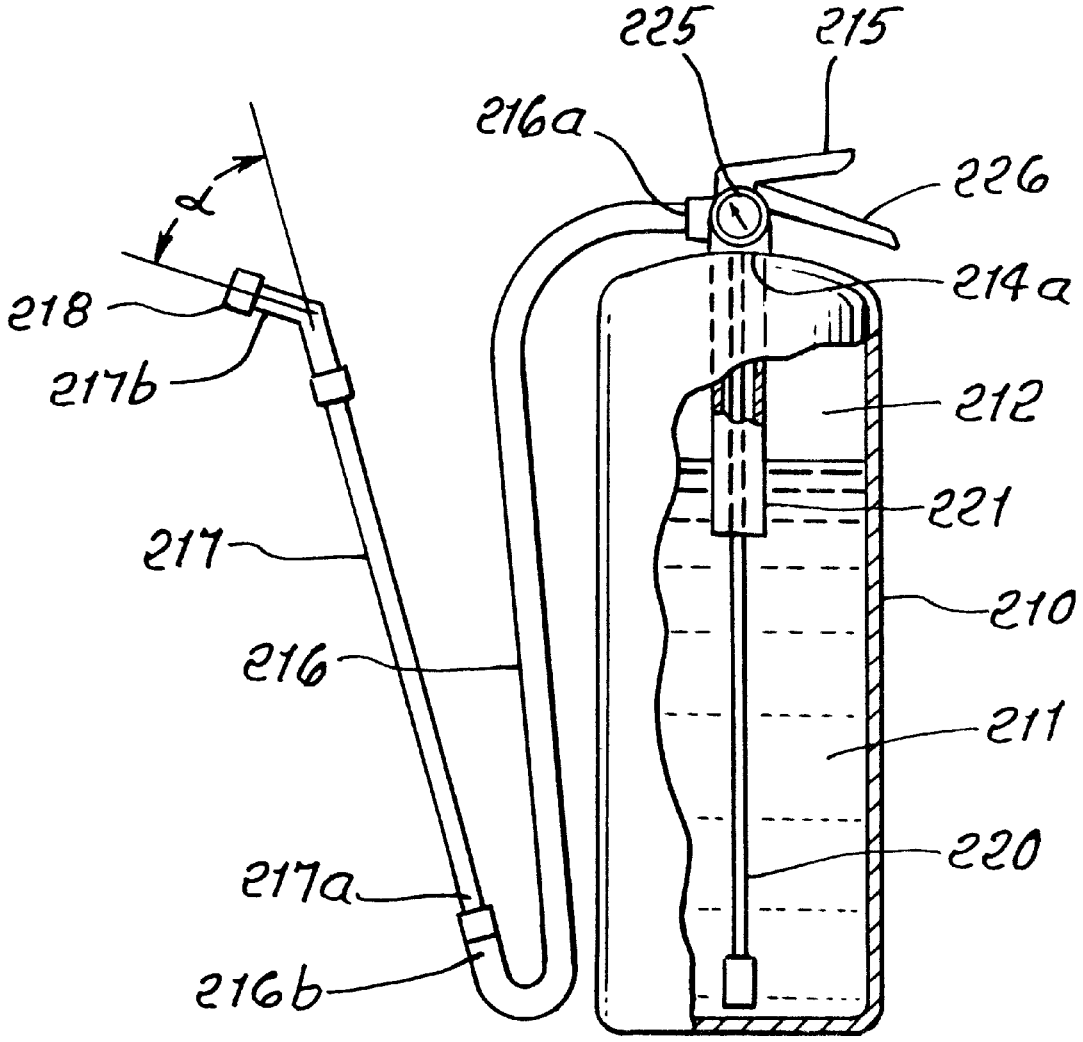
FIG. 7 is a view like FIG. 1, but showing modified apparatus, which is preferred.

The modified apparatus of FIG. 7 is like that of FIG. 1, and includes:

a) a container 210 containing pressurized aqueous liquid, such as water 211, b) a valve controlled outlet 214*a* from the container, there being a valve controlling handle 215, c) an elongated flexible tube 216 having an inlet end 216*a* to receive the pressurized liquid, and having an outlet end 216*b,* d) an elongated relatively stiff metallic tube 217 having an inlet 217*a* in communication with the flexible tube outlet end, the metallic tube having an angled outlet end portion 217*b* that extends at an angle $\alpha$ relative to a length direction of the metallic tube, where $$\alpha 50°,$$

e) a mist producing nozzle 218 at that outlet end portion,

Also included are a siphon tube 220 projecting into water 211, below pressurized gas 212; an anti-overfill tube 221; a pressure gauge 225, and a carrying handle 226, allowing ready depression of control handle projecting above 226. This form of the apparatus is preferred.

A series of full-scale fire tests was conducted, in which a portable water mist fire extinguisher as disclosed herein has been tested for use on cooking oil fires (Class K), and fires associated with woods and papers (Class A), flammable liquid (Class B) and electrical equipment (Class C). The extinguishing rates of the 9 liter extinguisher are Class K, 2-A, 2-B and Class C fires. In addition, the optimum parameters of the extinguisher required for extinguishing various types of fires, including water mist characteristics (spray angle, water droplet sizes and flow rates), discharge pressures, nozzle discharge angles, and the type of nozzles, have been determined.

Compared to conventional extinguishers, the water mist fire extinguisher is characterized by low cost, low water requirement, and high efficiency in suppressing various types of fires, and at the same time, it requires less clean-up, and produces no toxic and environmental problems. The water mist extinguisher as a cost-effective and sustainable fire suppression device is able to provide multipurpose protections for wide applications, including commercial cooking areas, office buildings, residential houses, hospitals, telecommunication facilities, clean rooms, and machinery spaces.

Water Spray Performance Tests

The objectives of this test series were to evaluate the spray performance (spray angles, spray coverage areas and flow rates, etc.) of different types of nozzles under various operating conditions and to identify potential nozzles that could be used for extinguishing cooking oil fires and other types of fires. The spray momentum, spray coverage area and water flow rate have been identified as the most important parameters to determine the effectiveness of water mist in suppressing cooking oil fires.

Full Jet Nozzle

FIG. 8 shows a nozzle with about 65° angularity relative to fluid supply pipes or ducts. Tests showed that , the 65° nozzle angularity, was substantially more effective in fire retardation (shorter time of extinction) than nozzles with 450 and 90° angularities. In these tests, the parameters were the same, (pressure, mist size, spray angle, etc.).

Spray Performance Over The Fryer

The objectives of this test series were to evaluate spray performance over the fryer under non-fire test conditions.

During the tests, the nozzle was located at the edge of the fryer and 0.47 m above the oil surface. The water mist was discharged towards the fryer under steady discharge pressure.

FIG. 9 shows the spray performances of the nozzle over the fryer under discharge pressure of 175 psi. The nozzle had a large coverage area over the fryer and produced a strong spray momentum.

Full-scale Tests With a Stationary Water Mist Extinguisher

The objectives of this test series were to study water mist capabilities and limitations against cooking oil fires and to identify the optimum spray characteristics required for extinguishing cooking oil fires, when a stationary water mist extinguisher was used. The stationary water mist extinguisher consisted of a water cylinder and three compressed air cylinders.

During the tests, the fryer contained 42 L of cooking oil (0.228 m of depth in the fryer). The cooking oil in the fryer was heated continuously at a certain rate and auto-ignited at a temperature of 368° C. After auto-ignition, the fire was to burn freely with the heating source remaining on for 1 min. The development of cooking oil fires during heating and pre-burning period is shown from FIG. 10 to FIG. 12. Water mist discharge started after a 60 second free burning period.

During the first test series, the stationary water mist fire extinguisher using both discharge pressure of 155 psi and discharge pressure of 170 psi nozzles could not extinguish the fire.

In the second fire test series, the nozzle was moved closer to the fryer (0.01 m away from the fryer) so that discharged water mist was able to reach the entire oil surface. During the first fire test in this series, the discharge pressure was 240 psi and the oil fire was extinguished at 7 seconds after water mist discharge. The oil fire was hit hard and the flame tip was pushed back towards the nozzle but no burning oil was splashed outside the fryer. After fire suppression, a part of the oil was splashed outside the fryer under continuing water mist discharge. During the second fire test in this series, the discharge pressure was reduced to 170 psi and the oil fire was extinguished at 3 seconds after water mist discharge. There was no feedback of the flame tip towards the nozzle and no oil splashing after afire suppression. The momentary fire flare-up during the fire suppression was small. During the third fire test in this series, the discharge pressure was further reduced to 125 psi. The oil fire size was enlarged during the fire suppression and the oil fire was extinguished at 19 seconds after water mist discharge. The extinguishing time was longer than those with high discharge pressures.

The second fire test series showed that the water mist fire extinguisher was able to extinguish cooking oil fires, but the nozzle must be placed at a location to allow discharged and spreading water mist to reach the entire oil surface. In addition, an optimum discharge pressure must be used so that short extinguishing time, only small momentary flare-up, and non-oil splashing can be achieved.

Full-scale Tests with a Portable Water Mist Fire Extinguisher

Fire tests involving two types of selected nozzles and two nozzle discharge angles were conducted following NFPA 10 "Standard for Portable Fire Extinguisher". The cooking oil in the fryer was heated continuously at a constant rate and auto-ignited at a temperature of 368° C. After auto-ignition, the fire was to burn freely with the heating source remaining on for 1 minute and the cooking oil temperature was further increased to 396° C. Water mist discharge started after 60 seconds free burning period. The extinguisher's nozzle was not extended over the front edge of the fryer during discharge. The heating source to the fryer remained ON during discharge.

For each test, fire and cooking oil temperatures, fire extinguishing time and operating parameters of the portable extinguisher (e.g., discharge pressure, flow rate and discharge period) were measured. Two thermocouples were located 25 mm and 50 mm, respectively, below the fuel surface, and two thermocouples were located 50 mm and 100 mm, respectively, above the fuel surface. These thermocouples were no closer to the fryer's wall than 70 mm.

In a successful test, after 1 minute of free burning, an operator activated a full water mist discharge. The fire was extinguished at 3 s after water mist discharge. No fire ball and no splashed burning oil were observed in the test. A large amount of steam was produced after the fire was extinguished (see FIG. 13). The total discharge duration was 15 seconds and 4.2 L of water was discharged. After 15 seconds of discharge, cooking oil was cooled below 320° C. and no re-ignition of the cooking oil was observed.

Full-scale Tests For Class A Fires

Full-scale fire tests were conducted to evaluate the effectiveness of the portable water fire extinguisher for class A fires following ULC "Standard for the Rating and Fire Testing of Fire Extinguishers and Class D Extinguishing Media". Wood cribs were used for Class A fire tests with Wood cribs were used for Class A fire tests with the rating of 2-A.

The wood cribs consisted of cube-shaped stacks formed from nominal 0.038 m×0.038 m×0.635 m long spruce built upon 0.064 m×0.064 m angle iron supported on concrete blocks at a height of 0.39 m above the floor. A number of wood members were 112 and arrangement of the crib was 16 layers of 7. A pan with 2 L of N-heptane was placed centrally beneath the crib and acted as an ignition source.

In each test, total mass of the crib was determined and the ignition fuel added to the pan. Heptane in the pan was then ignited and the crib allowed to burn until its mass was reduced to 55 percent of its original mass. The development of the wood crib fire is shown in FIG. 14. Water mist was applied to the crib from its three sides, and top and bottom, using a continuous discharge. After the crib fire was suppressed, the crib was left for 15 minutes and checked for re-ignition. During water mist application, no discharge was directed at the back of the crib, as required by ULC "Standard for the Rating and Fire Testing of Fire Extinguishers and Class D Extinguishing Media".

During the fire tests, the impact of the discharge pressure, flow rate and the discharge period on the effectiveness of the portable water mist fire extinguishers for Class A fires were investigated.

When water mist was discharged, no fire flare-up was observed, and the crib fire was quickly controlled (see FIGS. 15 and 16).

During a test, n-heptane fuel was replaced by the diesel fuel and other test conditions were the same. The diesel fuel fire was extinguished at 2 s after discharge and a small momentary fire flare-up was observed during suppression (see FIG. 21). The total discharge duration was 5 s and no re-ignition was observed. The total water quantity used in the test was 1.21 Liters.

See also FIGS. 17–20, with labeled parameters.

Full-scale Tests For Class C Fires

Suitability of the portable water mist fir extinguisher for use in Class C fires was evaluated in full-scale tests. Test protocols were based on ULC "Standard for the Rating and Fire Testing of Fire Extinguishers and Class D Extinguishing Media", and ULC "9 L Water Spray Fire Extinguisher". There was no fire involved in the tests.

A 60 Hz transformer (GE Electric) rated at 50 kV was used to supply the high voltage. The nozzle tip of the electrical charged extinguisher was connected to the high voltage secondary of the test transformer and placed 0.38 m from the center of a circular copper target that had a diameter of 0.25 m (see FIG. 22). A metallic cylinder, containing water at pressure of 220 psi, was then connected to the nozzle. The whole water mist system, including the nozzle, pipe and cylinder, was subjected to the high voltage. The cylinder was placed on a wooden stand to isolate it from the ground. All metallic connectors, including the circular electrode, had rounded edges to prevent the inception of partial discharge.

During the tests, the discharge of water mist against the target was activated first and then the voltage was turned on and increased in steps of 5 kV with 10 s at each step until 47.5 kV. The current in the primary winding of the transformer, as well as the leakage current were measured at each step by two battery-operated multimeters. At the maximum voltage of 47.5 kV, the discharge of water mist remained for 30 seconds. To increase the electric field or voltage between the nozzle and the circular electrode, their distance was reduced to 0.19 m and the tests were repeated. During the tests, two types of nozzles, were used to determine if the discharge of water mist could produce a shock hazard to the user (see FIGS. 23 and 24).

Test results showed that there was no breakdown between the nozzle tip and energized target when water mist was discharged toward the energized target for the full duration. The leakage current between the nozzle tip and energized target was increased with applied voltages and reduced with increasing distance between the nozzle tip and energized target igs. 74 and 75). The maximum leakage currents produced by both nozzles in the tests were approximately one third (0.38 m distance) and one half (0.19 m), respectively, below the threshold of involuntary startle reaction (500$\mu$) for electric current through the human body. This limit is set up by both the International Electrotechnical Commission (IEC) and Underwriters' Laboratories (UL) [10].

Discussion and Conclusion

Test results showed that the portable water mist fire extinguisher of the invention was suitable for use on cooking oil fire (Class K), wood crib fire (Class A), flammable liquid fire (Class B), and fire associated with electrical equipment (Class C). The extinguishing rates of the water mist fire extinguisher were Class K, 2-A, 2B and Class C.

To extinguish cooking oil and flammable liquid fires, water mist discharged from the extinguisher must reach the entire oil/fuel surface to cool the fire plume and fuel, and to displace oxygen and fuel vapour available for combustion.

As a result, compared to other types of extinguishers for use on liquid fires (for example, wet chemical agent), the operator must stand relatively close to fire hazards to allow discharged water mist to cover the entire fuel surface. In addition, like any other agents, the attack of water mist to liquid fires could cause a momentary fire flare-up in the initial suppressing stage, because the momentum in the water spray during discharge is transferred into a stream of air. This increases turbulence and stirring and brings air into the burning gases, resulting in increase in heat release rate of the fire. The size of the momentary fire flare-up is dependent on the type of fuel. As observed in tests, a large momentary fire flare-up is produced when the water mist extinguisher attacks n-heptane fires, while the sizes of momentary fire flare-up produced for attacking cooking oil and diesel fuel fires are small. Test results also showed that the discharge duration required for extinguishing cooking oil fires is relatively longer.

Test results for the disclosed water mist extinguisher showed that, the water quantity required for extinguishing cooking oil fires, and fires associated with electrical equipment is much less than 9 L. As result, a smaller size water mist fire extinguisher can be used for extinguishing these fires.

We claim:

1. The method of extinguishing a fire characterized by production of flames openly rising above an upwardly presented liquid fat or grease zone having an upper surface, the fat or grease being combustible to produce the fire, the steps that include a) providing a portable container and a mist forming nozzle in communication with the container contents, which are aqueous and pressurized, thereby to direct mist toward the flames, b) delivering container contents under pressure to the nozzle so that the nozzle forms a jet stream of mist delivered from the nozzle as a rapid and expanding flow of concentrated mist, i) said pressure to the nozzle being between 180 and 250 psi, ii) and said pressure to the nozzle being at a level or levels causing mist droplets to form, and to have cross sections between 400 and 1000 microns, c) directing said mist stream divergently downwardly into the flames to substantially encompass the flames and the entire upper surface of said fat or grease zone, and to flow toward the fat or grease zone, and for a time, which is less than about 15 seconds, to extinguish the flames and to lower the temperature of the surface of the fat or grease zone to a level below combustion temperature, with some of the mist being converted to billowing steam blocking access of air to the flames, d) said nozzle being directed toward the flames from a location above the flames and directed at an acute angle relative to vertical, e) providing an elongated flexible tube having an inlet end to receive said pressurized liquid, and having an outlet end, f) providing an elongated relatively stiff metallic tube having an inlet end in communication with the flexible tube outlet end, said metallic tube having an angled outlet end portion that extends at an angle $\alpha$ relative to a length direction of the metallic tube, where $\alpha>50°$, g) and locating said nozzle at said angled end portion of the metallic tube, h) said angled outlet end portion being caused to extend downwardly at a angle $\beta$ less than 35° relative to vertical, i) said step d) being carried out to effect rapid conversion of mist to steam which expands outwardly about said fat or grease zone, and hovers closely about said zone, j) and the entirety of said nozzle being located directly above said zone and at a spacing such that the downward stream of mist expands flowing downwardly, to quickly encompass, cool, and extinguish said flames.

2. The method of claim 1 wherein said container filled with said contents is one of the following:

i) a 9 liter unit ii) a 6 liter unit.

* * * * *